US006023015A

United States Patent [19]

Vale

[11] Patent Number: 6,023,015

[45] Date of Patent: Feb. 8, 2000

[54] PIANO HAMMER SHAPING TOOL

[76] Inventor: Raymond J. Vale, 6006 Forest Ledge, San Antonio, Tex. 78240

[21] Appl. No.: 09/256,024

[22] Filed: Feb. 23, 1999

[51] Int. Cl.[7] ..... G10G 7/00

[52] U.S. Cl. ..... 84/458; 84/453; 84/459; 451/59; 451/523; 451/539

[58] Field of Search ..... 84/458, 459, 460, 84/453, 254; 451/59, 523, 526, 538, 539

[56] References Cited

U.S. PATENT DOCUMENTS

| | | | |
|---|---|---|---|
| 696,025 | 3/1902 | Finney | 84/460 |
| 1,165,452 | 12/1915 | Rudolph | 451/495 |
| 1,344,318 | 6/1920 | Slye et al. | 239/57 |
| 1,570,177 | 1/1926 | Pointer | 451/495 |
| 4,206,574 | 6/1980 | Dotsko . | |
| 4,563,152 | 1/1986 | McClure | 433/39 |
| 4,823,515 | 4/1989 | Blome . | |
| 5,140,784 | 8/1992 | Walsh . | |
| 5,148,639 | 9/1992 | Sakai et al. | 451/59 |

*Primary Examiner*—Robert E. Nappi
*Assistant Examiner*—Shih-yung Hsieh
*Attorney, Agent, or Firm*—Jackson Walker LLP

[57] ABSTRACT

A hammer shaping tool is designed with two parts: a piano hammer template and a sanding strip. The template's face surface is a mirror of an desirably shaped piano hammer with side walls forming a channel along the face surface of the template. The width of the face surface, and consequently the channel, is generally the same as the width of the striking edge of the hammers. The sanding strip likewise has the same width as the striking edge of the hammers. The sanding strip is placed, cutting side against the hammer, on the striking edge of the hammer. The template is then placed against the low friction side of the sanding strip and a portion of the hammer. The sanding strip is pulled through the template channel, the low friction side of the sanding strip sliding against the face surface of the template, and the cutting surface of the sanding strip engaging the surface face of the piano hammer, cutting the hammer facing surface to the desired shape. The strip and guide can then be placed on another portion of the hammer and the process repeated, eventually shaping the entire hammer. The amount of pressure exerted on the tool against the hammer shoulders in conjunction with the sandpaper grit size dictates the amount of felt removed from the hammer.

4 Claims, 1 Drawing Sheet

PIANO HAMMER SHAPING TOOL

BACKGROUND OF THE INVENTION

1. Field of The Invention

Applicant's invention relates to a hammer shaping tool; and, more particularly, to a tool that is designed to correctly shape and voice piano hammers.

2. Background Information

The modern pianoforte, or piano, was developed in the early 1700's when a harpsichord was modified to include an escapement action, which involved depressing a key thereby causing a hammer to strike a string. The piano was later refined to include repetition, or double-escapement, action which is now, in modified forms, employed in most pianos. Pianos are found in many forms, however, they are generally comprised of a frame, strings, a sound board, casing and wrest plank, and the action. The action consists of a system of levers whereby when a key is pushed, the hammers are actuated to strike the piano strings. The strike of the hammer against the string causes the string to vibrate and, consequently, produces sound. A piano's sound can be divided in two parts; loudness, which depends upon the amplitude of the vibration—determined by the power with which the hammer strikes the string—and the pitch, which depends upon the frequency of the vibration—determined by the diameter, length, and tautness of the string. In order for the piano to create pleasing sounds, the strings must be tuned such that harmonic vibrations and harmonic series are formed.

To produce sounds that are in tune, clear and precise without fouling other strings, the hammers must be flat with sharp edges. In order to shape the piano hammers (also referred to as "voicing" or "dressing" the hammers), technicians must smooth out ridges and grooves that develop in the hammers. Ideally, the hammers should have square shoulders with flat even strike points (crown) and a symmetrical shape.

Felt is commonly used to create the striking surface of the hammers. However, the hammers may vary in structure and materials used in their construction. The construction design of piano hammers is based upon initial cost, upkeep cost durability, and aesthetic characteristics (i.e. characteristics of the sound created upon operation).

A common problem encountered during the use of conventional tools and methods to shape or voice the hammers, is that the hammer are incorrectly shaped. Technicians accidently shape the hammers at an angle, or leave a rounded or lipped edge on the hammer. Additionally, it is difficult for technicians to shape each hammer in a desired form, or in a form that is consistent from one hammer to the next. These problems are due, in part to variances in the way tools are held and applied to the hammers, as well as most of the work being done "free hand." The shape of the hammer affects the sound characteristics produced by the piano, therefore it is desirable to have consistent, ideally shaped piano hammers. Finally, even when the technician is able to correctly shape the hammer, it is a time intensive process.

Thus, there is a need for a tool which a) correctly and accurately dresses piano hammers, b) dresses hammers in a consistent fashion, and c) reduces the amount of time needed to adequately dress the hammers.

SUMMARY OF THE INVENTION

The present invention is an apparatus and method for shaping piano hammers.

In order to solve the difficulties presented in attempting to accurately shape piano hammers while at the same time reducing the time necessary to shape said hammers, a piano shaping tool has been developed using a template and flexible sanding strip. Another advantage resulting from this invention is that the hammers are consistently shaped from one hammer to the next Additionally, this apparatus is so easy to use that it reduces the time needed to shape the hammers, as well as reducing the technical expertise required to adequately shape hammers.

The tool is designed with two parts: a piano hammer template and a sanding strip. The template is molded, machined, or otherwise shaped such that its face surface is a mirror of a desirably shaped piano hammer. On either side of the template are side walls which form a channel along the face surface of the template and which is used to hold both the sanding strip and the piano hammer in place. The width of the face surface, and consequently the channel, is generally the same as the width of the striking edge of the hammers. The sanding strip likewise has the same width as the striking edge of the hammers.

In order to shape a piano hammer, the sanding strip is placed, cutting side against the hammer, on the striking edge of the hammer. The template is then placed against the low friction side of the sanding strip and a portion of the hammer. The technician then pulls the sanding through the template channel, the low friction side of the sanding strip sliding against the face surface of the template, and the cutting surface of the sanding strip engaging the surface face of the piano hammer, cutting the hammer facing surface to the desired shape. The sanding strip and template can then be placed on another portion of the hammer and the process repeated, eventually shaping the entire hammer. The amount of pressure exerted on the tool against the hammer shoulders in conjunction with the sandpaper grit size dictates the amount of felt removed from the hammer.

It should be understood that the piano hammer shaping tool may vary based upon construction goals.

BRIEF DESCRIPTION OF THE DRAWINGS

These and other advantages of the invention will become more readily apparent from the following detailed description of the presently preferred exemplary embodiments, taken together with the accompanying drawings, of which.

DETAILED DESCRIPTION OF THE PREFERRED EMBODIMENT

Figure 1:
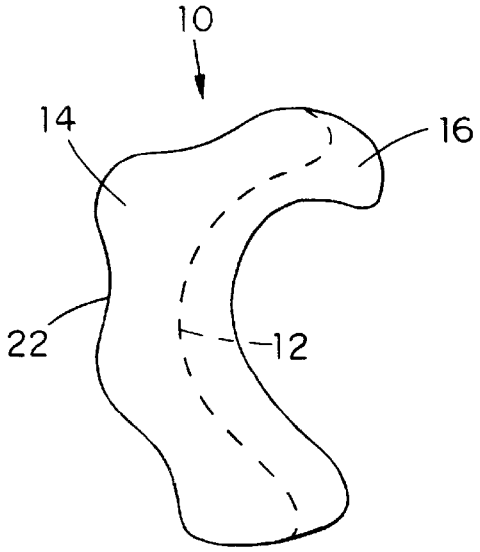
FIG. 1 is a side elevation view of the present invention.

FIG. 1 illustrates a side elevation view of the present invention. The piano hammer template (10) is comprised of a rigid structure, shaped in such a manner that the face surface (12) of the template (10) mirrors a portion of a desirably shaped piano hammer facing surface (not shown), when viewed from the side or in profile. Generally, the face surface (12) will be smooth and relatively slick, in order that a sanding strip (50) more easily slide against the face surface (12). Attached to a first side (14) is a first side wall (16) which extends beyond the face surface (12) of the template (10), which in combination with a second side wall (20) (see FIG. 3.) forms a channel (24) along the face surface (12) of the template (10) in which the piano hammer to be shaped will fit and through which the sanding strip (50) will slide.

Figure 2:
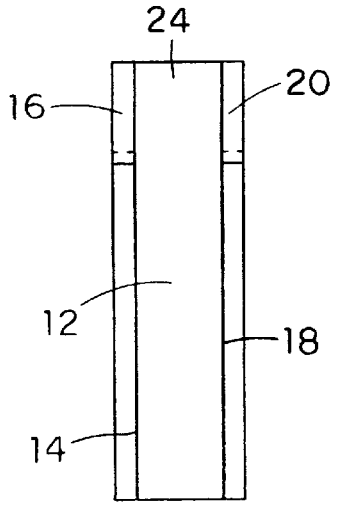
FIG. 2 is a front elevation view of the present invention.

FIG. 2 illustrates a front elevation view of the template (10). It further shows the attachment of the first side wall (16) to the first side (14) of the template (10). Likewise, attached to a second side (18) is a second side wall (20). A channel (24) is formed along the face surface (12). The first side wall (16) and the second side wall (20) generally will have the same shape.

Figure 3:
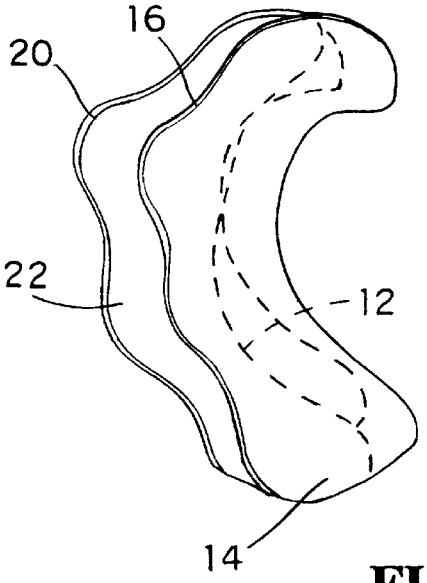
FIG. 3 is a side and back perspective view of the present invention.

FIG. 3 illustrates a side and back perspective view of the template (10). It shows that generally, the back (22) of the template (10) is shaped to meet the contour of the users hand. This enables the user to more easily hold the template (10). The first side wall (16) and the second side wall (20) are attached to the template (10) so that no lip or groove is formed along the back (22) of the template (10).

Figure 4:
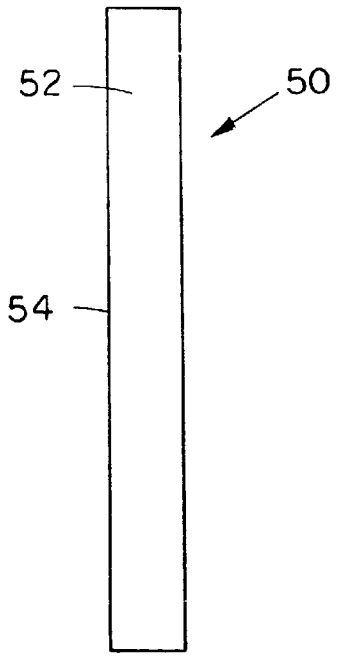
FIG. 4 is a front elevation view of the present invention.

FIG. 4 illustrates a front elevation view of the flexible sanding strip (50). The flexible sanding strip has a first side (52) with a cutting surface, and a second side (54) with a low friction surface. The flexible sanding strip (50) is designed to be held by the template (10) against a piano hammer to be shaped. The flexible sanding strip (50) is held cutting surface (52) against the piano hammer, and low friction surface (54) against the face (12) of the template (10). In order to shape a piano hammer, the sanding strip (50) is placed, cutting surface (52) against the facing surface of the hammer. The template (10) is then urged against the low friction side (54) of the sanding strip (50) and a portion of the hammer. The technician pulls the sanding strip (50) through the template channel (24), the low friction side (54) of the sanding strip (50) sliding against the face surface (12) of the template (10), and the cutting surface (52) of the sanding strip (50) engaging the facing surface of the piano hammer, cutting the hammer facing surface to the desired shape. The sanding strip (50) and template (10) can then be placed on another portion of the hammer and the process repeated, eventually shaping the entire hammer. The amount of pressure exerted on the template (10) against the hammer in conjunction with the sandpaper grit size dictates the amount of felt removed from the hammer.

Although the invention has been described with reference to specific embodiments, this description is not meant to be construed in a limited sense. For example, the shapes and sizes of the template may be altered to correctly shape various sized piano hammers. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An apparatus for shaping the facing surface of piano hammers, comprising:

a piano hammer template having a face surface shaped to mirror a portion of a desirably shaped facing surface for said piano hammer; and a piano hammer sanding strip having a first cutting surface, and a second low friction surface, said strip adapted to slide between said template and said piano hammer, said cutting surface engaging said facing surface and said low friction surface slidable along said face surface of said template as said sanding strip is pulled between said template and said hammer.

2. The apparatus of claim 1 further comprising first and second template side walls, said walls extending beyond said template face surface to form a channel.

3. The apparatus of claim 2 wherein the width of said sanding strip is approximately equal to the width of said channel.

4. A method for shaping a piano hammer facing surface, comprising the steps of:

placing a piano hammer sanding strip, having a first cutting surface and a second low friction surface, against said piano hammer facing surface such that said first cutting surface contacts said piano hammer facing surface;

urging a template face surface against said sanding strip second low friction surface, said template having a face surface shaped to mirror a portion of a desirably shaped facing surface for said piano hammer; and pulling said sanding strip from between said template and said piano hammer facing surface, said cutting surface engaging said facing surface and said low friction surface sliding along said face surface of said template.

* * * * *